US005647881A

United States Patent [19]

Zhang et al.

[11] Patent Number: 5,647,881

[45] Date of Patent: Jul. 15, 1997

[54] SHOCK RESISTANT HIGH EFFICIENCY VACUUM CLEANER FILTER BAG

[75] Inventors: Zhiqun Zhang, Woodbury; John C. Winters, Birchwood Village, both of Minn.

[73] Assignee: Minnesota Mining and Manufacturing Company, St. Paul, Minn.

[21] Appl. No.: 533,001

[22] Filed: Sep. 25, 1995

Related U.S. Application Data

[63] Continuation-in-part of Ser. No. 425,292, Apr. 20, 1995, abandoned.

[51] Int. Cl.[6] ..... B01D 46/02

[52] U.S. Cl. ..... 55/382; 15/347; 55/486; 55/DIG. 2; 55/DIG. 39; 428/36.1

[58] Field of Search ..... 55/DIG. 2, DIG. 3, 55/361, 381, 382, 486, DIG. 39; 15/347, 352, DIG. 8; 428/36.1, 246, 284, 298

[56] References Cited

U.S. PATENT DOCUMENTS

| | | | |
|---|---|---|---|
| Re. 30,782 | 10/1981 | van Turnhout | 264/22 |
| 3,939,860 | 2/1976 | Gusman et al. | 55/486 |
| 3,971,373 | 7/1976 | Braun | 128/146.2 |
| 4,116,648 | 9/1978 | Busch | 55/382 |
| 4,164,400 | 8/1979 | Wald | 55/382 |
| 4,215,682 | 8/1980 | Kubik et al. | 128/205.29 |
| 4,257,791 | 3/1981 | Wald | 55/382 |
| 4,375,718 | 3/1983 | Wadsworth et al. | 29/592 E |
| 4,429,001 | 1/1984 | Kolpin et al. | 428/283 |
| 4,589,894 | 5/1986 | Gin et al. | 55/274 |
| 4,592,815 | 6/1986 | Nakao | 204/165 |
| 4,917,942 | 4/1990 | Winters | 428/286 |
| 5,080,702 | 1/1992 | Bosses | 55/382 |
| 5,230,800 | 7/1993 | Nelson | 210/496 |
| 5,244,703 | 9/1993 | Bosses | 55/382 |
| 5,306,534 | 4/1994 | Bosses | 428/35.2 |
| 5,419,953 | 5/1995 | Chapman | 55/486 |

FOREIGN PATENT DOCUMENTS

| | | | |
|---|---|---|---|
| 0 161 790 A3 | 11/1985 | European Pat. Off. . | |
| 0338479 | 10/1989 | European Pat. Off. | 55/DIG. 2 |
| 39 05 565 A1 | 7/1989 | Germany . | |
| 3905565 A1 | 7/1989 | Germany . | |
| 1107821 | 4/1989 | Japan . | |
| 2116338 | 5/1990 | Japan . | |
| 4058927 | 2/1992 | Japan . | |
| WO93/21812 | 11/1993 | WIPO . | |
| WO95/05232 | 2/1995 | WIPO . | |
| WO95/05501 | 2/1995 | WIPO . | |

OTHER PUBLICATIONS

Report No. 4364 of the Naval Research Laboratories, published May 25, 1954 entitled "Manufacture of Superfine Organic Fibers" by Wente, Van A., Boone, C. D. and Feluharty, E. L.

Wente, Van A. "Superfine Thermoplastic Fibers" in *Industrial Engineering Chemistry*, vol. 48, p. 1342 et seq. (1956).

*Primary Examiner*—Jay H. Woo

*Assistant Examiner*—Duane S. Smith

*Attorney, Agent, or Firm*—Gary L. Griswold; Walter N. Kirn; William J. Bond

[57] ABSTRACT

There is provided a vacuum cleaner bag with high fine particle removal efficiency under normal and shock loading conditions, shock loading including a short term challenge with high particle concentrations (e.g., when a vacuum is used to pick up a pile of debris). The bag also exhibits high loading capacity without significant loss in pressure drop. The bag includes an outer support layer, a fibrous filter layer that is charged to create electrets, and an inner diffusion layer that is substantially unbonded to the filter layer, except at necessary bag seams required for assembly of the filter bag.

23 Claims, 2 Drawing Sheets

SHOCK RESISTANT HIGH EFFICIENCY VACUUM CLEANER FILTER BAG

This application is a continuation in part of U.S. Ser. No. 08/425,292, filed on Apr. 20, 1995 now abandoned.

BACKGROUND AND FIELD OF INVENTION

The present invention relates to a vacuum cleaner bag as well as a method of producing a vacuum cleaner bag.

Conventionally, vacuum cleaner bags have been constructed of paper. Paper bags are low cost and generally acceptable for removing and holding the large particles picked up by a vacuum cleaner. However, vacuum cleaners have become more effective at picking up fine particles and paper bags are typically quite inefficient at removing these fine-type particles from the vacuum cleaner air stream. These fine particles tend to remain in the air stream and are passed through the paper bag sidewalls with the exiting air creating significant amounts of indoor fine respirable particulate pollution. In order to reduce the amount of fine particulate discharged from the vacuum cleaner bag sidewalls, it has been proposed to employ a nonwoven fibrous filter layer in forming the vacuum cleaner bag. U.S. Pat. No. 4,589,894 proposes a filter layer that comprises a web of random synthetic polymeric microfibers, less than 10 microns in diameter on average. This filter layer web has a specific range of basis weights and air permeability. Further, in order to protect this relatively fragile filter layer, the filter layer is sandwiched between two more resilient outer nonwoven layers, for example, spun bond nonwoven webs.

U.S. Pat. No. 4,917,942 also addresses the problem of providing a vacuum cleaner bag with improved filtration efficiency against fine particles. The filter material comprises a microfiber web of synthetic polymers which web has been directly adhered to a support web. The microfiber web is charged to induce electrets, which provides a filter media having high capture efficiency for fine submicron particles with a low pressure drop.

Following the above two approaches are U.S. Pat. Nos. 5,080,702 and 5,306,534 in the name of Bosses. The '702 patent describes a disposable vacuum cleaner bag filter material which, like the '894 patent, comprises a microfiber web and a support layer. Like the '894 patent, the microfiber filter layer is not charged, however, unlike the '894 patent there is no inner support web. Like the '942 patent, no inner support layer is described as needed, however, unlike the '942 patent the filter web is not described as being charged. The patent examples exemplify that the melt blown microfiber web liner does not clog as rapidly as a standard cellulose (paper-like) liner. The examples also tested for resistance to tearing of the seams and of the paper when the filter was folded or flexed.

The U.S. Pat. No. 5,306,534 describes a charged filter web, which is attached to a textile fabric to form a reusable vacuum cleaner bag with high filter efficiency. The electret filter web material is a charged melt blown microfiber web (like the '942 patent) placed between two outer support layers (like the '894 patent), for example, described as spun bond materials. The charged melt blown microfiber filter web layer(s) and spunbond layers are pattern bonded together.

PCT Publication WO 93/21812 (Van Rossen) describes a vacuum cleaner bag, such as described in U.S. Pat. No. 4,917,942, which is provided with a scrim layer on the face opposite the vacuum cleaner hose inlet to provide specific abrasion resistance against large sand particles and the like.

The scrim layer is bonded to the filter layer only at the vacuum cleaner bag end seams simplifying manufacturing.

Also commercially available is an industrial dust bag having an inner layer of a melt blown web (about 20 gm/m$^2$) that is bonded only to the periphery of the bag. This bag is used as a copy machines toner particle bag and has an outer composite filter layer as described in U.S. Pat. No. 4,917,942, above.

The above patents all primarily address overall filter efficiency, particularly with respect to fine particles of a vacuum cleaner bag under normal-type operating conditions where a steady low concentration stream of particulates are being discharged into the bag. The present invention is directed at providing a filter bag with good fine particle removal efficiency over an extended period of time without filter blinding, which also has superior fine particle removal efficiency under shock loading conditions. Shock loading conditions occur when high concentrations of particles are discharged into the vacuum cleaner bag over a short period of time, such as where a vacuum cleaner is used to pick up a large pile of dust or debris. The invention is also concerned with providing a vacuum cleaner bag which displays a long service life without significant reduction in air flow or increase in pressure drop.

SUMMARY OF THE INVENTION

A high efficiency vacuum cleaner filter bag resistant to shock loading is provided comprising a filter laminate composite having at least one air inlet. The filter laminate composite comprises:

a) an outer support layer of a porous material, b) at least one charged fibrous filter layer containing electrets, and c) an inner diffusion layer which is substantially unbonded to said filter layer, the diffusion layer having an air permeability of at least 50 m$^3$/min/m$^2$, a tensile strength of at least about 0.1 kg/cm and formed of fibers having an effective fiber diameter of at least about 10 μm.

DESCRIPTION OF THE PREFERRED EMBODIMENTS

Figure 1:
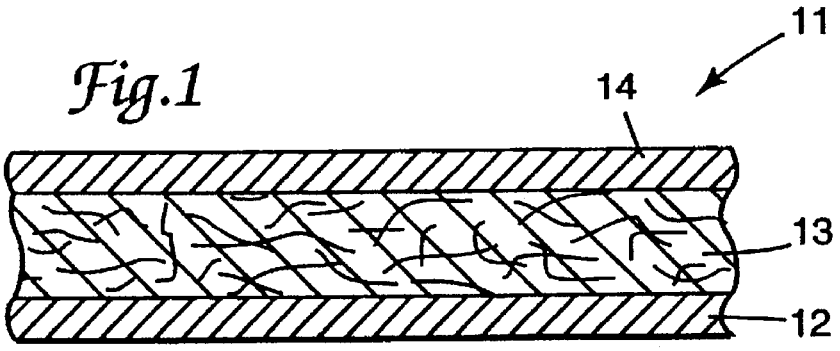
FIG. 1 is a cut away cross-sectional view of the filter material used to form the invention vacuum cleaner bag.

FIG. 1 represents a cross-section of the composite material 11 used to form the vacuum cleaner bag of the invention. Outer layer 12 is a support layer primarily for protection of the inner nonwoven fibrous filter layer 13. The inner nonwoven filter layer 13 is comprised of a nonwoven web of charged electret containing fibers, which can be any suitable open nonwoven web of charged fibers. The filter web could be formed of the split fibrillated charged fibers described in U.S. Pat. No. 30,782. These charged fibers can be formed into a nonwoven web by conventional means and optionally joined to a supporting scrim such as disclosed in U.S. Pat. No. 5,230,800, forming the outer support layer 12.

Alternatively, the nonwoven filter layer 13 can be a melt blown microfiber nonwoven web, such as disclosed in U.S. Pat. No. 4,917,942, which can be joined to a support layer during web formation as disclosed in that patent, or subsequently joined to a support web in any conventional manner to form the outer support layer 12. The melt blown nonwoven web is charged after it is formed, however, it has been proposed to charge the microfibers while they are being formed and prior to the microfibers being collected as a web. The melt blown nonwoven webs are typically formed by the process taught in Wente, Van A., "Superfine Thermoplastic Fibers" in *Industrial Engineering Chemistry*, volume 48, pages 1342 et seq., (1956), or Report No. 4364 of the Naval Research Laboratories, published May 25, 1954, entitled "Manufacture of Superfine Organic Fibers" by Wente, Van A., Boone, C. D. and Feluharty, E. L., which fibers are collected in a random fashion, such as on a perforated screen cylinder or directly onto a support web or in the manner described in PCT Application No. WO 95/05232 (between two corotating drum collectors rotating at different speeds creating a flat surface and a undulating surface). The collected material can then subsequently be consolidated, if needed, and charged, such as in the manner described in U.S. Pat. No. 4,215,682. Alternative charging methods for the filter web layer to form electrets include the methods described in U.S. Pat. Nos. 4,375,718 or 4,592,815 or PCT Application No. WO 95/05501.

The fibers forming the nonwoven filter layer are generally formed of dielectric polymers capable of being charged to create electret properties. Generally polyolefins, polycarbonates, polyamides, polyesters and the like are suitable, preferred are polypropylenes, poly(4-methylpentenes) or polycarbonates, which polymers are free of additives that tend to discharge electret properties. Generally, the filter layer should have a permeability of at least about 2 $m^3/min/m^2$, preferably at least 10 $m^3/min/m^2$ up to about 400 $m^3/min/m^2$. The basis weight of the filter layer 13 is generally 10 to 200 $g/m^2$. If higher filtration efficiency is required, two or more filter layers may be used.

The nonwoven filter layer can also include additive particles or fibers which can be incorporated in known manners such as disclosed in U.S. Pat. Nos. 3,971,373 or 4,429,001. For example, if odor removal is desired, sorbent particulates and fibers could be included in the nonwoven filter layer web.

The composite material forming the vacuum cleaner bag sidewalls is further provided with an inner diffusion layer 14, which is substantially unbonded to the filter layer 13 except at the periphery of the vacuum filter bag 20 along a seam 25.

Both the outer support layer 12 and the inner diffusion layer 14 can be formed of a nonwoven or woven fibrous material. Preferably, for ease of manufacturing, cost, and performance the outer support layer 12 and the inner diffusion layer 14 are nonwoven fibrous web materials formed at least in part from heat-sealable or weldable thermoplastic fibers. Examples of such materials include spunbond webs, spunlace webs and consolidated carded and "Rando" webs. However, even if heat or sonic bonding is used to form the edge seam of the vacuum cleaner bag, the outer support layer need not necessarily be heat-sealable if either or both of the inner diffusion layer 14 and the filter layer 13 are heat sealable. As such, the outer support layer 12 can be a non heat-sealable, porous fibrous material, such as a paper, scrim, cloth or the like.

Generally, the outer support layer 12 is limited only by the necessity that it has a strength sufficient to resist tearing in ordinary use. Further, the outer support layer should generally have an air permeability of at least about 50 $m^3/min/m^2$, preferably at least 100 $m^3/min/m^2$ up to about 500 $m^3/min/m^2$ or more. The basis weight of the outer support layer 12 is generally 10 to 100 $g/m^2$.

The outer support layer 12 can be either bonded or non-bonded to the filter layer 13 with the exception of the seam 25 area. However, if the outer support layer is bonded to the filter layer 13, it is done so in a manner that will not significantly decrease the open area of the filter web. Acceptable bonding methods include adhesives, spot ultrasonic welding or heat bonding or the like. Generally, the bonded area should be no more than 20% of the filter cross-sectional area, generally less than 10%.

The diffusion layer 14 should have an air permeability of generally at least about 50 $m^3/min/m^2$, preferably 100 $m^3/min/m^2$ but less than 1000 $m^3/min/m^2$, most preferably from 100 $m^3/min/m^2$ to 700 $m^3/min/m^2$. If the permeability is more than about 1000 $m^3/min/m^2$, the diffusion layer is too open to act as an initial barrier to the high velocity particles entering the bag, which adversely affects the shock loading efficiency of the bag. The diffusion layer 14 generally has a basis weight of from about 10 to 100 $g/m^2$, preferably 15 to 40 $g/m^2$. The diffusion layer has a tensile strength (as defined in the examples) of at least about 0.10 kg/cm, preferably at least about 0.15 kg/cm. The fibers of the inner diffusion layer should have an effective fiber diameter of at least about 10 μm. Suitable diffusion layers include spun bond webs of thermoplastic fibers and consolidated carded webs such as point bonded carded webs of polyolefin (e.g., polypropylene) staple fibers.

Figure 2:
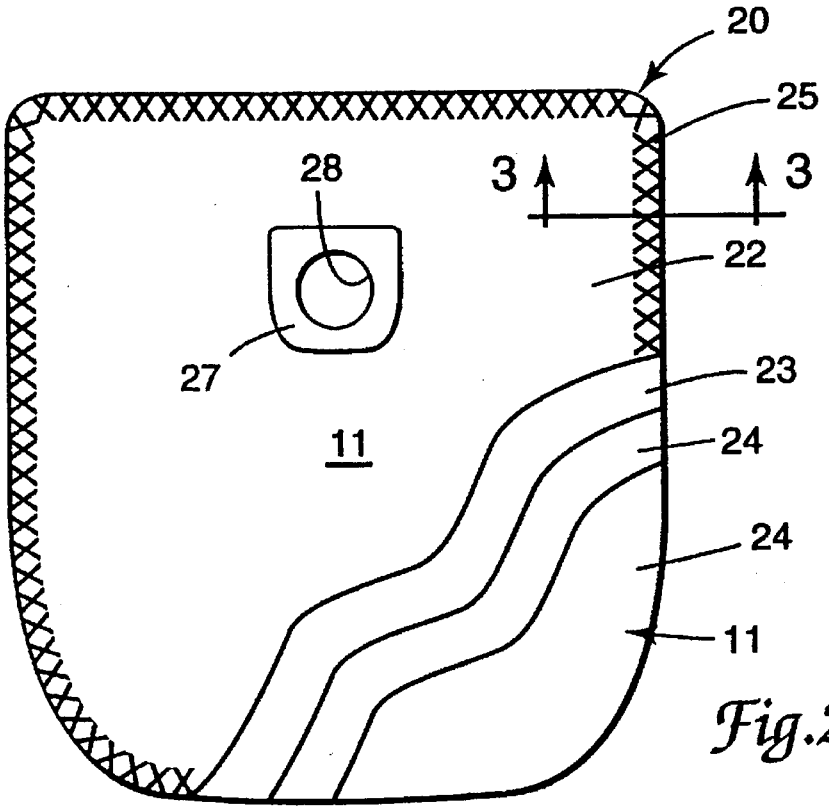
FIG. 2 is a top elevational view of the invention vacuum cleaner filter bag with a partial cut away.
Figure 3:
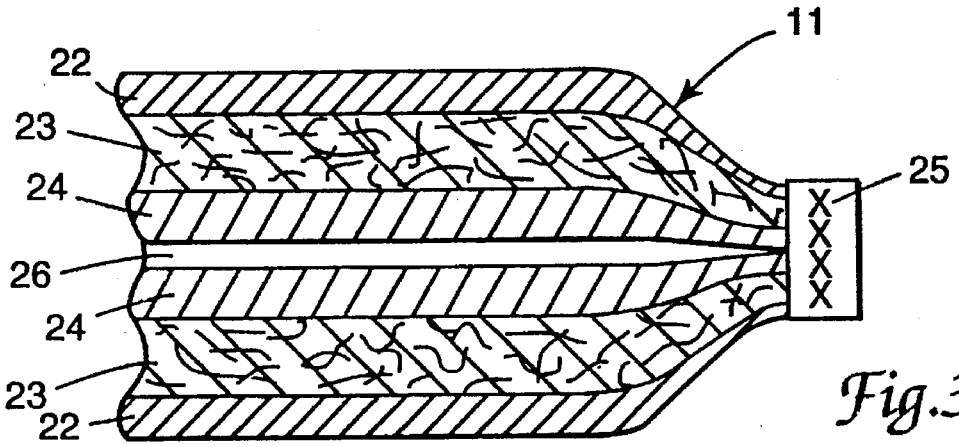
FIG. 3 is a enlarged cross-sectional view of an edge region of the invention vacuum cleaner filter bag.

The invention vacuum cleaner filter bag 20 can be formed by any suitable method, as long as the inner diffusion layer 14 is substantially unattached to the charged electret filter layer 13 throughout the entire surface of the filter bag. Generally, as shown in FIG. 2, the inner diffusion layer 24 is only joined to the filter layer 23 along the periphery of the vacuum cleaner filter bag at seam 25 and around the attachment collar 27 (not shown). The seam 25 joins two filter composites 11 forming vacuum bag 20 with an inner open area 26 for capture of particulate. Collar 27 provides access into the inner open area 26. Generally, the seam 25 can be formed by any conventional means, heat sealing or ultrasonic sealing are preferred, however, other conventional methods such as adhesives can be employed. Sewing is not preferred as a seam formed in this manner is likely to leak. The attachment collar 27 can be of any conventional design. The attachment collar forms an inlet 28, which accommodates the vacuum cleaner dust feed conduit.

A method for producing the disposable filter bag comprises placing two air permeable layers, forming the support layer and the diffusion layer, on either face of an air permeable filter material containing synthetic thermoplastic fibers and welding or adhering the at least three layers along a continuous peripheral edge line to form an edge seam. Prior to forming the edge seam, an inlet opening is provided allowing the air to be filtered to enter the filter bag. Furthermore, an air permeable outermost layer of a textile fabric can be laminated to the bag to form a durable bag.

EXAMPLES 1–3 AND COMPARATIVE EXAMPLES A–G

A series of vacuum cleaner filters of the present invention were prepared using melt blown electret filter web material having a basis weight of 40 $gm/m^2$. The filter webs were either bonded or unbonded to an outer support layer of either a polypropylene spun bond fabric having a Frazier permeability of 204 $m^3/min/m^2$ and a basis weight of 30 $gm/m^2$ (spun bond available from Don & Low, Scotland, UK) or to a paper substrate commercially available. The unbonded inner diffusive layer was a polypropylene spun bond fabric having a Frazier permeability of 625 $m^3/min/m^2$ and a basis weight of (0.5 $oz/yd^2$) 17 $gm/m^2$ (Celestra available from Fiberweb North America Inc.). The filtration performance of these electret filter laminate constructions having a diffusive inner layer was compared to known vacuum cleaner bag constructions. The comparative bags (summarized in Table 2 below) included: a commercial paper filter vacuum bag with a melt blown filter layer (Comparative A); uncharged melt blown (MB) filter media vacuum cleaner bag constructions having bonded and unbonded outer support substrates (30 $gm/m^2$ spun bond polypropylene available from Don & Low, Scotland, UK) and a bonded inner diffusion layer (17 $gm/m^2$ Celestra) (Comparatives D and E); supported electret charged bags (same support layer as for the uncharged filter web) without an inner layer, with a bonded inner diffusion layer of 17 $gm/m^2$ Celestra, with a cellulose unbonded inner diffusion layer and a unbonded spun bond (17 $gm/m^2$ Celestra) inner diffusion layer on only one face of the vacuum cleaner bag (comparative Examples B, C, F and G, respectively).

Shock Loading Test

The assembled bags were subjected to simulated in-service tests involving a commercially available residential vacuum cleaner as the test apparatus. The vacuum cleaner, fitted with the test filter bag, was placed in a controlled environment chamber which allowed determinations on particles penetrating the filter bags by a utilizing a particle counter (LASAIR Model 1002 available from Particle Measuring Systems, Inc. Denver, Colo.) and an air velocity meter (Model 8350 available from TSI Inc., St. Paul, Minn.).

For a shock loading test of the filter bag's ability to withstand abrasion and rapid loading, the challenge dust was a cement-sand mixed dust of SAKRETE™ Sand Mix available from Sakrete, Inc., which was fed at a rate of 120 gm/sec into the hose attachment of the vacuum cleaner which passed through a sealed aperture in the environmental chamber wall. The total dust load per test was 350 gms. Particle emission counts in the exhaust from the vacuum cleaner were measured continuously for 2 minutes. The results of these evaluations are summarized in Tables 1 and 2. The Emission Reduction data uses Comparative B as the comparison melt blown without an inner diffusion layer.

TABLE 1

Vacuum Cleaner Bag Performance - Shock Loading Test

| Sample | Construction(support layer/filter layer/diffusion layer, // = bonded, / = unbonded) | Particle Count Emissions (0.1–10 microns) | % Emission Reduction compared to paper (%) |
|---|---|---|---|
| Comparative A | paper/MB electret/none[1] | 182,130 | 0 |
| Example 1 | paper/MB electret[1]/spun bond[2] | 140,709 | 23 |

[1]Vacuum Cleaner bag Kenmore #2050558 from Sears.
[2]Basis weight 17 $gm/m^2$ (1/2 oz) Celestra.

The particle emission data in Table 1 demonstrate that the inner diffusive layer of the present invention was able to enhance the filtration efficiency of a conventional vacuum cleaner bag construction under shock loading conditions with a mixture of fine and large particles.

TABLE 2

Vacuum Cleaner Blown Microfibrous Electret Bag Constructions Shock Loading Test

| Sample | Construction(support layer/filter layer/inner layer, // = bonded / = unbonded) | Particle Count Emissions (0.1–10 microns) | Emission Reduction compared to melt blown without inner diffusive layer (%) |
|---|---|---|---|
| Comparative B | spun bond// MB electret[3]/none | 67,814 | 0 |
| Comparative C | spun bond//MB electret//spun bond | 65,907 | 3 |
| Comparative D | spun bond//MB/spun bond[4] | 64,378 | 5 |
| Comparative E | spun bond/MB/spun bond | 60,276 | 11 |
| Comparative F | spun bond//MB electret/ cellulose[5] | 59,299 | 13 |
| Comparative G | spun bond//MB electret/spun bond one face[6] | 58,616 | 14 |
| Example 2 | spun bond//MB electret/spun bond | 39,916 | 41 |
| Example 3 | spun bond/MB electret layer/spun bond | 35,123 | 48 |

[3]Microfibrous vacuum filter prepared according to U.S. Pat. No. 4,917,942, MB - 40 $gm/m^2$ basis weight; spun bond - 30 $gm/m^2$ basis weight.
[4]Microfibrous vacuum filter prepared according to U.S. Pat. No. 4,589,894, MB-basis weight 40 $gm/m^2$
[5]Cellulosic layer, basis weight 19 $gm/m^2$
[6]Microfibrous vacuum filter prepared according to Van Rossen PCT WO 93/21812.

The data of Table 2 demonstrates that the combination of supported filter laminates of electret filter media with an unbonded(/) spun bond inner diffusion layer provide superior performance by reducing the particle emissions by greater than 40 percent to up to about 50 percent for a preferred thermoplastic heat sealable spun-bond inner diffusion layer under shock loading conditions. Example 3 demonstrated that preferably, both the support layer and the spun bond inner diffusion layer are unbonded to the filter layer.

Visual Analysis

A visual evaluation of a vacuum bag's ability to withstand particle leakage and resultant staining of the exterior layer was performed using a visual analysis system comprising a video camera RS 170 displaying 640×480 pixels, for imaging, combined with scanning/digital computation device-Power Vision 60 available from Acuity Inc., Nashua, N.H. The vacuum bag constructions subjected to the cement dust shock loading test were scanned over a standard viewing area on the exterior surface of the vacuum cleaner bag opposite the vacuum cleaner air inlet to measure a corresponding gray scale. A threshold gray scale value of 75 was determined by visual inspection. The densitometry scan of the tested exterior surface calculated the percent of viewed particle staining area by assessing the number of pixels with a reading less than the established 75 gray scale. The results are presented in Table 3.

TABLE 3

Vacuum Cleaner Blown Microfibrous Electret Bag Constructions Digitized Visual Analysis

| Sample | Average Gray Scale | Stained Area (%) |
|---|---|---|
| Comparative B | 74 | 50 |
| Example 2 | 83 | 29 |
| Example 3 | 82 | 31 |

This visual analysis demonstrates that the unbonded spun bond inner diffusion layer significantly reduced the area of dust particle staining after the shock loading test compared to a similar construction without the spun bond inner diffusion layer.

Low Concentration Dust Particle Loading Test

Examples 2 and 3 and comparative Examples B, D and E were also subjected to a low concentration dust particle loading test. This test, which utilizes the environmental chamber enclosed vacuum cleaner test system described previously utilizing residential vacuum cleaner Electrolux Model 4460, available from Electrolux U.K., was fitted with test filter bag samples and the challenge dust was a fine cement dust Type 1A available from LEHIGH Portland Cement. The challenge dust was presented at a feeding rate of 1 gm/min for a period of 2 minutes. The particle emissions from the exhaust were measured continuously for 5 minutes. Data on particle count versus loading from the evaluations are presented in graphic format in FIG. 4, wherein the particle count penetrating the bag construction is plotted on the Y-axis (in units of total counts per 6 seconds) and time, in seconds, is plotted along the X-axis.

After a steady state condition, to account for the particle emissions due to background, had been realized with the test apparatus 2 grams of challenge dust was introduced into the vacuum cleaner system from time equal 60 seconds for the two minute period. The curves, which represent the particle concentration downstream from the test filter materials, show a dramatic change in slope, indicative of the large number of particles passing through the filter media. As introduction of challenge dust into the vacuum system continued the downstream particle count established a plateau and gradually decreased to a level similar to the background after the particle challenge ceased. Vacuum cleaner bags with the an electret filtration layer demonstrated significantly better performance in comparison to the non-electret filter layer constructions. This data demonstrates that the non-electret filter media (comparative Examples D and E) allows a significantly higher level of particle penetration through the filter media.

Fine Dust Challenge

Comparative Examples B, D and E and Examples 2 and 3 were also tested as flat filter media webs using a test duct arrangement. The media was exposed to a PTI Fine Dust challenge at a constant face velocity of 10 cm/s. This test is specifically designed to evaluate performance of vacuum cleaner bag constructions to a low concentration particle challenge simulating normal carpet and upholstery vacuuming. Particle concentrations upstream and downstream from the filter media were measured simultaneously by two particle counters and the particle penetration was calculated by the test system HIAC/ROYCO FE 80 available from Pacific Scientific, HIAC/ROYCO Division, Silver Spring, Md. The results of these evaluations are presented in Table 4.

TABLE 4

Vacuum Cleaner Blown Microfibrous Electret Bag Constructions Performance to Fine Particle Challenge

| Sample | Particle Penetration (%) |
|---|---|
| Comparative B | 4.19 |
| Comparative D | 28.8 |
| Comparative E | 29.9 |
| Example 2 | 3.38 |
| Example 3 | 3.83 |

The above data demonstrate that under a fine dust challenge, a charged electret filtration media (comparative Example B, Example 2 and Example 3) significantly increases the fine particle capture efficiency of a vacuum bag filter construction.

Fine Dust Holding Capacity

In a further test, assembled vacuum cleaner bags were subjected to a simulated in-service environment involving a commercially available residential vacuum cleaner as the test apparatus. The vacuum bags of dimension 24.4 cm by 39.6 cm had an effective filtration inner surface area of 1900 $cm^2$ accounting for the weld, inlet collar and aperture. Different basis weights of spun bond inner diffusion layers were employed for Examples 2, 4 and 5. Examples 4 and 5 are in all other respects identical to Example 2. The vacuum cleaner, fitted with a test filter bag, was placed in a controlled environment chamber to make particle count determinations of the particle penetration through the test filter bags. The challenge dust utilized was from ASTM F 608-89, Annexes A1, consisting of a 9:1 by weight mixture of silica sand and laboratory talcum. The mixture of dust particles was injected into the vacuum cleaner at a feed rate of 60 grams/minute with a total dust load of 1000 grams. The air flow through the vacuum cleaner system was monitored continuously as a function of dust loading volume. The mass of dust loading of the vacuum cleaner bag was determined after a 20% reduction and a 30% reduction of the initial air flow. This is a general determination of filter capacity and useful life. The results of these evaluations are presented in Table 5.

TABLE 5

Fine Dust Holding Capacity Challenge

| Samples | Diffusion Layer ($g/m^2$) | After a 20% Flow Reduction Dust Holding (gms) | After a 30% Flow Reduction Dust Holding (gms) |
|---|---|---|---|
| Comparative B | none | 200 | 270 |
| Example 2 | 17 | 320 | 440 |
| Example 4 | 34 | 420 | 620 |
| Example 5 | 68 | 460 | 630 |

This data demonstrates that the vacuum cleaner bag constructions that contain the inventive diffusive layer and electret filter layer have a significantly higher loading capacity for fine dust compared to the electret filter layer alone while maintaining a high air volume flow. In this regard, the invention bag would have a significantly longer useful life, while also providing a high particle capture efficiency combined with better shock loading for improved overall vacuum cleaner performance.

In summary, Tables 1, 2 and 3 demonstrate the high effectiveness of the diffusive layer with the electret layer to reduce particle emissions when subjected to shock loading.

Figure 4:
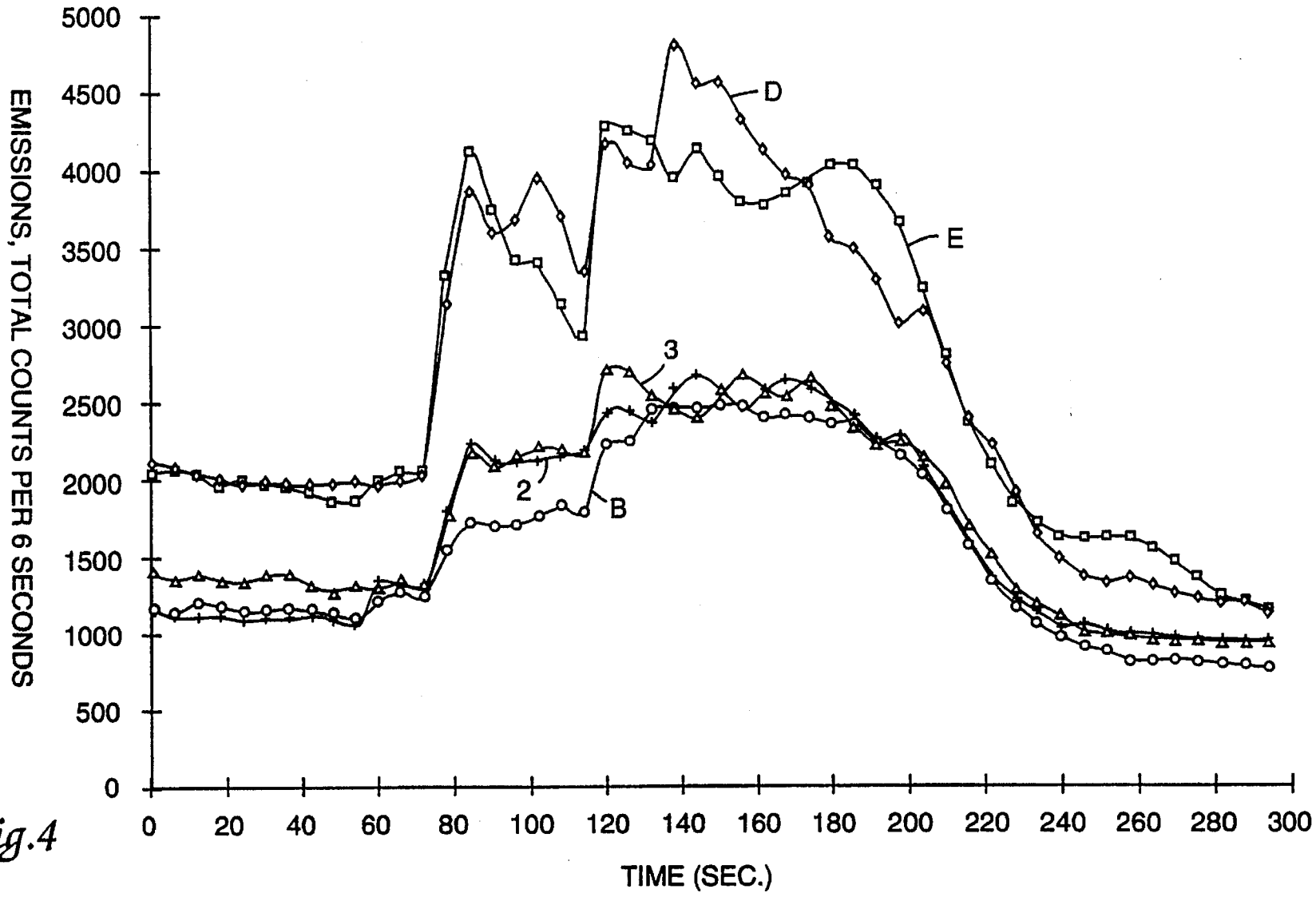
FIG. 4 is a graph of filter bag performance versus time for a constant fine particle challenge.

Also, as shown in Table 4 and FIG. 4, the electret filter material is important in reducing particle emissions due to a low concentration challenge as would be found in normal carpet cleaning. Table 5 demonstrates improved dust holding capacity of a vacuum filter bag by adding a diffusion layer.

EXAMPLES 6–11 AND COMPARATIVE EXAMPLE H–8

A series of vacuum cleaner filters were prepared as were Examples 1–3 except that the unbonded inner diffusion layer was varied to include spun bond polypropylene, nylon and PET, as well as a carded polypropylene web. Also included was an unbonded inner diffusion layer of 20 $gm/m^2$ melt blown polypropylene. These bags were then tested for shock loading as per Examples 1–3 and comparative Examples A–G. Also tested was the change in air flow through the bag (comparing the beginning and end air flow for each bag). The testing equipment was cleaned and recalibrated prior to this series of testing. The results show that various spun bond inner diffusion layers and also a carded web provided superior particle emission reductions, as reported for the 17 $gm/m^2$ spun bond unbonded inner diffusion layers in Examples 1–3 in Table 2 (e.g., particle emission reductions of greater than 40 percent under shock loading conditions). The Emisson reduction for Examples 6–11 and Comparative I are relative to Comparative H. The Table 6 data also shows that the flow reduction was superior for the example vacuum cleaner filter bags (Examples 6–11) as compared to the comparative Example I vacuum cleaner bag which used an inner diffusion layer of melt blown polypropylene. Also included in Table 6 is a bag quality factor, which is the percent emission reduction value divided by the percent flow reduction during the test. For the invention bags the quality factor is generally at least 2.0 and preferably at least 2.3.

TABLE 6

Vacuum Cleaner Blown Microfibrous Electret Bag Constructions Shock Loading Test

| Sample | Construction (support Layer/filter/ Inner layer, // = bonded, / = unbonded) | Emission Reduction compared to melt blown without inner diffusive layer (%) | Velocity Reduction during test (%) | Quality Factor |
|---|---|---|---|---|
| Comparative H | spun bond//MB electret[1]/none | 0 | 32 | — |
| Comparative I | spun bond//MB electret[1]/MB[2] 20 $gm/m^2$ melt blown | 30 | 28 | 1.1 |
| Example 6 | spun bond//MB electret[1]/spunbond[3] Reemay 2275 | 41 | 17 | 2.4 |
| Example 7 | spun bond//MB electret[1]/spunbond[4] 1 oz. Celestra | 48 | 14 | 3.4 |
| Example 8 | spun bond//MB electret[1]/spunbond[5] 1/2 oz. Celestra | 48 | 18 | 2.7 |
| Example 9 | spun bond//MB electret[1]/spunbond[6] 1/2 oz. Cerex | 49 | 20 | 2.4 |
| Example 10 | spun bond//MB electret[1]/spunbond[7] Reemay 2011 | 50 | 20 | 2.4 |
| Example 11 | spun bond//MB electret[1]/carded[8] | 41 | 18 | 2.3 |

[1]Microporous vacuum filter prepared according to U.S. Pat. No. 4,917,942, MB - 40 $gm/m^2$ basis weight; spun bond - 30 $gm/m^2$ basis weight.
[2]20 $g/m^2$ melt blown polypropylene web.
[3]Reemay ™ 2275, 25.4 $g/m^2$ basis weight polyethylene terphthalate (PET), available from Reemay Inc., Old Hickory, TN.
[4]Celestra ™ - 1 oz polypropylene available from Fiberweb North America, Inc., Simpsonville, SC.
[5]Celestra ™ - 1/2 oz polypropylene available from Fiberweb North America, Inc., Simpsonville, SC.
[6]Cerex ™ - 1/2 oz nylon available from Cerex Advanced Fabrics, L.P., Cantonement, FL.
[7]Reemay ™ 2011, 28.3 $gm/m^2$, available from Reemay Inc., Old Hickory, TN.
[8]Point bonded polypropylene carded web with a basis weight of 31 $gm/m^2$.

Table 7 reports the Effective Fiber Diameter (EFD), Permeability (P) and Tensile strength for the inner diffusion layers reported in Table 6. The effective fiber diameter is measured by (1) measuring the pressure drop across the filter web; (2) measuring the solidity of the media, or the fractional volume of fibers in the web; (3) measuring the thickness of the filter web; and (4) calculating the effective diameter as follows:

$$EFD = \sqrt{\frac{64\mu UL\alpha^{1.5}(1+56\alpha^2)}{\Delta P}}$$

where μ is the viscosity of the fluid, U is the air velocity, L is the thickness of the filter web, α is the solidity of the filter web, and ΔP is the pressure drop across the filter web.

The tensile strength is measured by measuring the cross-web and downweb tensile strength (according to ASTM F 430-75 (using ASTM D828)) the two tensiles were multiplied and the square root taken to yield a composite web tensile strength.

The air permeability was measured according to ASTM D737.

TABLE 7

Diffusion Layer Properties

| Material | Tensile Strength, kg/cm | EFD, μm | P, $m^3/min/m^2$ |
|---|---|---|---|
| 20 gm BMF | 0.03 | 5.9 | 42 |
| 1/2 oz Celestra | 0.18 | 23.2 | 625 |
| Carded PP | 0.25 | 17.4 | 166 |
| Reemay 2275 | 0.37 | 25.7 | 452 |
| Reemay 2011 | 0.4 | 23.4 | 581 |
| 1/2 oz Cerex | 0.3 | 20.8 | 677 |
| 1 oz Celestra | 0.57 | 18.3 | 185 |
| Cellulose tissue | 0.46 | 20 | 124 |

$$\text{Tensile} = \sqrt{\text{CrossWebTensile*DownWebTensile}}$$

We claim:

1. A vacuum cleaner filter bag resistant to shock loading comprising a flat filter laminate composite formed into the filter bag having at least one air inlet defining means in said flat filter laminate composite and at least one seam forming said flat filter laminate composite into said filter bag said flat filter laminate composite comprising;

a) an outer support layer of a porous material, b) at least one charged fibrous filter layer containing electrets, and c) an inner diffusion layer which is unbonded to said filter layer except at the at least one seam, the diffusion layer having an air permeability of at least 50 $m^3/min/m^2$, a tensile strength of at least about 0.1 kg/cm, and formed of fibers having an effective fiber diameter of at least about 10 μm.

2. The vacuum cleaner filter bag of claim 1 wherein said filter layer comprises a meltblown nonwoven filter layer.

3. The vacuum cleaner filter bag of claim 1 wherein said filter layer comprises a fibrillated fiber nonwoven filter layer.

4. The vacuum cleaner filter bag of claim 1 wherein said filter layer has an air permeability of from 2 to 400 $m^3/min/m^2$.

5. The vacuum cleaner filter bag of claim 1 wherein said filter layer has a basis weight of from 10 to 200 $g/m^2$.

6. The vacuum cleaner filter bag of claim 1 wherein said filter layer is formed at least in part of heat sealable thermoplastic fibers.

7. The vacuum cleaner filter bag of claim 1 wherein the inner diffusion layer is formed of a nonwoven fibrous web.

8. The vacuum cleaner filter bag of claim 7 wherein the diffusion layer nonwoven fibrous web is formed of thermoplastic fibers and has an air permeability of from 100 $m^3/min/m^2$ to 1000 $m^3/min/m^2$.

9. The vacuum cleaner filter bag of claim 8 wherein the thermoplastic fibers are at least in part heat sealable fibers.

10. The vacuum cleaner filter bag of claim 8 wherein the diffusion layer fibrous web is a spun bond nonwoven web having a basis weight of from 10 to 40 $g/m^2$ and an air permeability of from 100 to 700 $m^3/min/m^2$.

11. The vacuum cleaner filter bag of claim 8 wherein the diffusion layer fibrous web has a basis weight of from 10 to 100 $g/m^2$.

12. The vacuum cleaner filter bag of claim 8 wherein the diffusion layer fibrous web has a tensile strength of at least about 0.15 kg/cm and the fibers have an effective fiber diameter of at least about 15 μm.

13. The vacuum cleaner filter bag of claim 8 wherein said outer support layer comprises a fibrous nonwoven web having an air permeability of from 50 to 500 $m^3/min/m^2$ and a basis weight of from 10 to 100 $g/m^2$.

14. The vacuum cleaner filter bag of claim 10 wherein said outer support layer is a spun bond nonwoven web of thermoplastic heat sealable fibers.

15. The vacuum cleaner filter bag of claim 1 wherein said outer support layer is bonded to said filter layer across the filter face.

16. The vacuum cleaner filter bag of claim 1 wherein said outer support layer is not bonded to said filter layer across the filter face.

17. The vacuum filter bag of claim 1 wherein said filter laminate composite layers are bonded along a peripheral seam.

18. The vacuum cleaner bag of claim 1 wherein the inner diffusion layer provides a 13 percent reduction in shock loading particle emissions.

19. The vacuum cleaner bag of claim 10 wherein the inner diffusion layer provides a 40 percent reduction in shock loading particle emissions.

20. The vacuum cleaner bag of claim 1 wherein the filter has a quality factor of at least about 2.0.

21. The vacuum cleaner bag of claim 1 wherein the filter has a quality factor of at least about 2.3.

22. The vacuum cleaner bag of claim 1 wherein the inner diffusion layer is a spun bond web or a carded web.

23. The vacuum cleaner bag of claim 1 wherein the outer support layer is paper.

* * * * *